US006328616B1

(12) United States Patent
Nakamura et al.

(10) Patent No.: US 6,328,616 B1
(45) Date of Patent: Dec. 11, 2001

(54) TRIM-TILT DEVICE FOR A MARINE PROPULSION UNIT

(75) Inventors: Tamotsu Nakamura; Omito Toyoshima; Hisao Takayanagi; Keiji Orihara, all of Gyoda (JP)

(73) Assignee: Showa Corporation (JP)

( * ) Notice: Subject to any disclaimer, the term of this patent is extended or adjusted under 35 U.S.C. 154(b) by 0 days.

(21) Appl. No.: 09/616,396

(22) Filed: Jul. 14, 2000

(30) Foreign Application Priority Data

Jul. 16, 1999 (JP) ..... 11-203900

(51) Int. Cl.[7] ..... B63H 5/125

(52) U.S. Cl. ..... 440/61

(58) Field of Search ..... 440/53, 56, 61; 92/51, 52, 53

(56) References Cited

U.S. PATENT DOCUMENTS

| | | | | |
|---|---|---|---|---|
| 2,953,335 | * | 9/1960 | Kiekhaefer | 440/61 |
| 3,250,240 | * | 5/1966 | Ziegler | 440/61 |
| 5,156,561 | * | 10/1992 | Kinoshita | 440/61 |
| 5,975,968 | * | 11/1999 | Nakamura | 440/61 |
| 6,042,435 | * | 3/2000 | Nakamura | 440/61 |
| 6,062,924 | * | 5/2000 | Nakamura | 440/61 |
| 6,213,823 | * | 4/2001 | Nakamura et al. | 440/61 |

* cited by examiner

*Primary Examiner*—S. Joseph Morano
*Assistant Examiner*—Ajay Vasudeva
(74) *Attorney, Agent, or Firm*—Orum & Roth

(57) ABSTRACT

In a trim-tilt device for a marine propulsion unit 20, a cylinder 41 of a cylinder device 21 is covered with a tank 28 constituting a hydraulic fluid supply/discharge device 22 and a relief valve 131 is opened when hydraulic pressure of the tank 25 becomes higher than a fixed value, so that hydraulic fluid of the tank 25 can be relieved for the second tilt chamber 32B.

6 Claims, 7 Drawing Sheets

TRIM-TILT DEVICE FOR A MARINE PROPULSION UNIT

BACKGROUND OF THE INVENTION

1. Field of the Invention

The present invention relates to a trim-tilt device for a marine propulsion unit such as an outboard motor or inboard/outboard motor.

2. Description of the Related Art

Conventionally, the trim-tilt device for a marine propulsion unit has a cylinder device interposed between a hull and the propulsion unit which is tiltably supported by the hull. By controlling supply and discharge of hydraulic fluid from a hydraulic fluid supply/discharge device to a cylinder device or vise versa, the cylinder device is expanded and contracted to thereby trim and tilt the marine propulsion unit.

A prior art trim-tilt device for a marine propulsion unit is described in Japanese Patent Application No. 11-112856. This application suggests a cylinder device for a trim-tilt device for a marine propulsion unit comprising a housing connected to one of a hull and a marine propulsion unit and which forms a large-diameter trim chamber. A cylinder is telescopically inserted into the trim chamber of the housing which forms a small-diameter tilt chamber. A large-diameter trim piston is fixed to an end portion of the cylinder within the trim chamber of the housing which partitions the trim chamber into a first trim chamber of a cylinder accommodation side and a second trim chamber of an anti cylinder accommodation side. A piston rod is connected to the other of the hull and the marine propulsion unit and is telescopically inserted into the tilt chamber of the cylinder. A small-diameter tilt piston is fixed to an end of the piston rod within the tilt chamber of the cylinder which partitions the tilt chamber into a first tilt chamber of a piston rod accommodation side and a second tilt chamber of an anti piston rod accommodation side. Additionally, in the cylinder device, a portion of the cylinder or the cylinder device which projects outward from the housing in the trim operable region is covered with a tank housing constituting a hydraulic fluid supply/discharge device. According to this embodiment, since the cylinder of the cylinder device does not touch water in the outside, it is covered with the tank housing and it can be rustproof easily and steadily by hydraulic fluid within the tank housing.

In the above mentioned trim-tilt device for a marine propulsion unit disclosed in Japanese Patent Application No. 11-112856, if the operation of the pump of the trim-tilt device stops in a trim operable region (the state in which the cylinder device does not finish the trim-up operation) during forwarding sailing and an obstacle in the water such as a floating log etc., collides with the propulsion unit such that a hydraulic fluid supply/discharge flow passage, from the hydraulic fluid supply/discharge device to the cylinder device, is locked, the piston rod and the cylinder in a body carry out a trim-stroke to the housing and the tank housing. At this time, in the trim-tilt device of the propulsion unit, due to the boosting of the hydraulic pressure at the locked state in a first tilt chamber, a buffer valve of a tilt piston is opened to transfer this hydraulic pressure to a second tilt chamber, so that an impact can be absorbed.

However, when the piston rod the cylinder transfer (trim-stroke) to the housing and the tank housing as described above, there is a possibility that the tank housing which is made of resin is destroyed due to the rapid increase of an internal pressure of the tank, or an end plate of the pump motor which is made of resin is destroyed, that covers a pump chamber provided so as to communicate to the tank.

SUMMARY OF THE INVENTION

The object of the present invention is to avoid an abnormal application of pressure of the pump by movement of a cylinder according to the collision of an obstacle in the water or the like in the case that a cylinder of a cylinder device is covered with a tank housing of a hydraulic fluid supply/discharge device in a trim-tilt device for a marine propulsion unit.

According to the present invention, there is disclosed a trim-tilt device for a marine propulsion unit, wherein a cylinder device is mounted between a hull and the marine propulsion unit freely tiltably supported by the hull. A hydraulic fluid is supplied from a hydraulic fluid supply/discharge device into the cylinder device and is discharged from the cylinder device into the hydraulic fluid supply/discharge device to thereby expand and contract the cylinder device and thereby trim and tilt the marine propulsion unit.

The cylinder device comprises:

- a housing connected to one of the hull and marine propulsion unit to form a large-diameter trim chamber;
- a cylinder telescopically inserted into the trim chamber and forming a small-diameter tilt chamber;
- a large-diameter trim piston fixed to an end portion of the cylinder within the trim chamber of the housing and serving to partition the trim chamber into an first trim chamber of a cylinder accommodation side and a second trim chamber of an anti cylinder accommodation side;
- a piston rod being connected to the other of the hull and the marine propulsion unit that is telescopically inserted into the tilt chamber of the cylinder; and
- wherein the cylinder device has a small-diameter tilt piston comprising a buffer valve which is fixed to an end of a piston rod within a tilt chamber of the cylinder, which partitions a tilt chamber into a first tilt chamber of a piston rod accommodation side and a second tilt chamber of an anti piston rod accommodation side and which is open when hydraulic pressure of the first tilt chamber becomes higher than a fixed value, so that a hydraulic fluid of the first tilt chamber can transfer to the second tilt chamber.

A portion of the cylinder of said cylinder device which projects outward from the housing in the trim operable region is covered with a tank housing constituting a hydraulic fluid supply/discharge device, comprising relief valve which is opened when a hydraulic pressure of the tank becomes higher than a fixed value, so that hydraulic fluid of the tank can be relieved for the second trim chamber to avoid an abnormal application of pressure of the pump by movement of the cylinder due to addition of the impact in the direction that expands the cylinder device to the marine propulsion unit.

BRIEF DESCRIPTION OF THE DRAWINGS

The present invention will be more fully understood from the detailed description given below and from the accompanying drawings which should not be taken to be a limitation on the invention, but are for explanation and for understanding only.

The drawings

DESCRIPTION OF THE PREFERRED EMBODIMENTS

Figure 1:
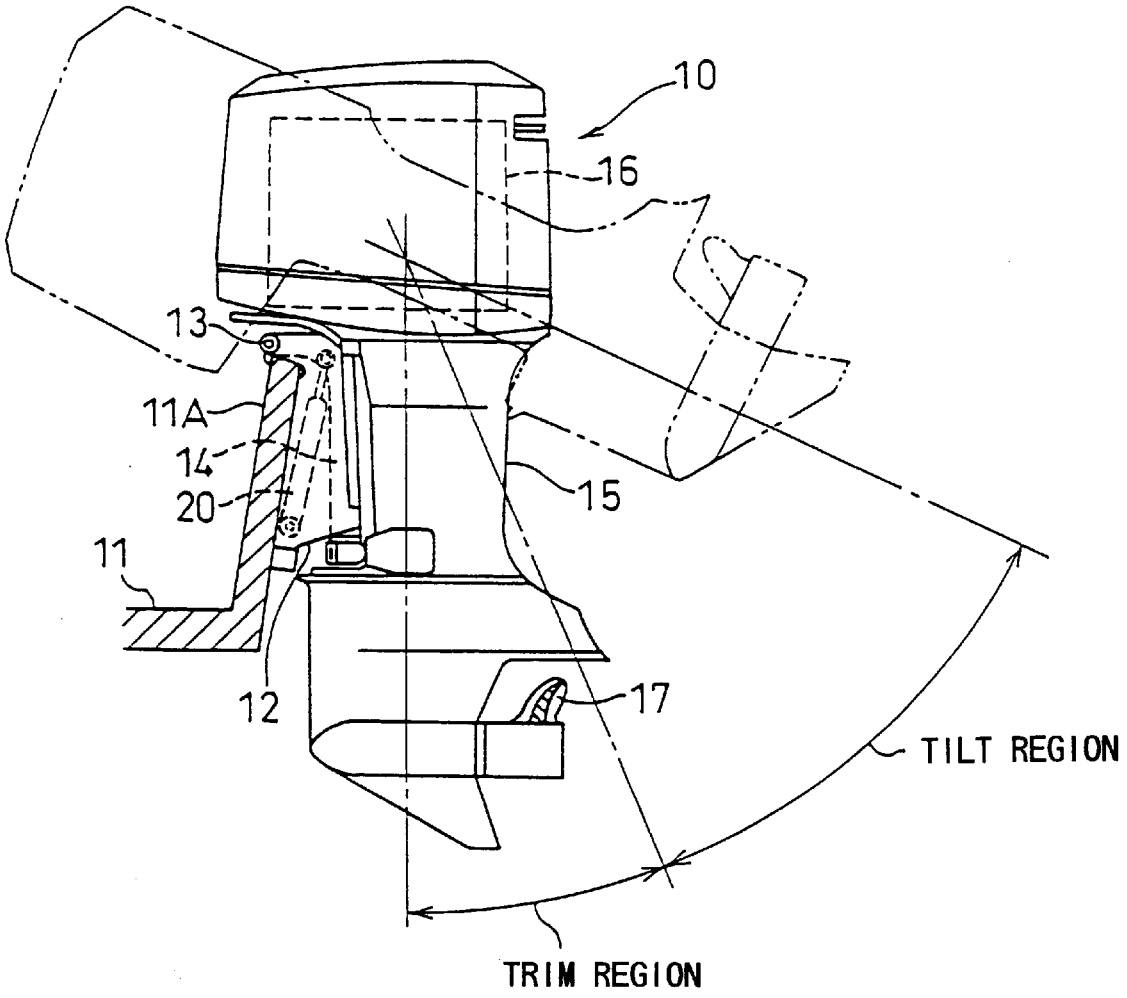
FIG. 1 is a view illustrating a marine propulsion unit.

As shown in FIG. 1, a marine propulsion unit 10 in the form of an outboard motor, or an inboard/outboard motor, has a damp bracket 12 fixed to a stern board 11A of a boat hull 11. To the clamp bracket 12 a swivel bracket 14 is pivoted through a tilt shaft 13 and is tiltable about the substantially horizontal shaft. To the swivel bracket 14 a propulsion unit 15 is pivoted through a steerage-changing shaft that is substantially vertically disposed, and not illustrated, in such a way that the propulsion unit 15, is rockable about the steerage-changing shaft. An engine unit 16 is loaded at the top of the propulsion unit 15 and a propeller 17 is fitted to a lower part of the propulsion unit 15.

In the marine propulsion unit 10, the propulsion unit 15 is tiltably supported by the damp bracket 12 fixed to the hull 11 through the tilt shaft 13 and swivel bracket 14. A cylinder device 21 of a trim-tilt device 20 is interposed between the clamp bracket 12 and the swivel bracket 14. The cylinder device 21 is expanded and contracted by supply or discharge of hydraulic fluid between a hydraulic fluid supply/discharge device 22 and the cylinder device 21. The propulsion unit 15 is thereby made tiltable in a trim or tilt region of FIG. 1. It is to be noted that the marine propulsion unit 10 may take an optimum sailing posture with respect to the water surface by retaining the propulsion unit 15 in a state of a relatively gentle slope within the trim region.

(Cylinder Device 21)

Figure 2:
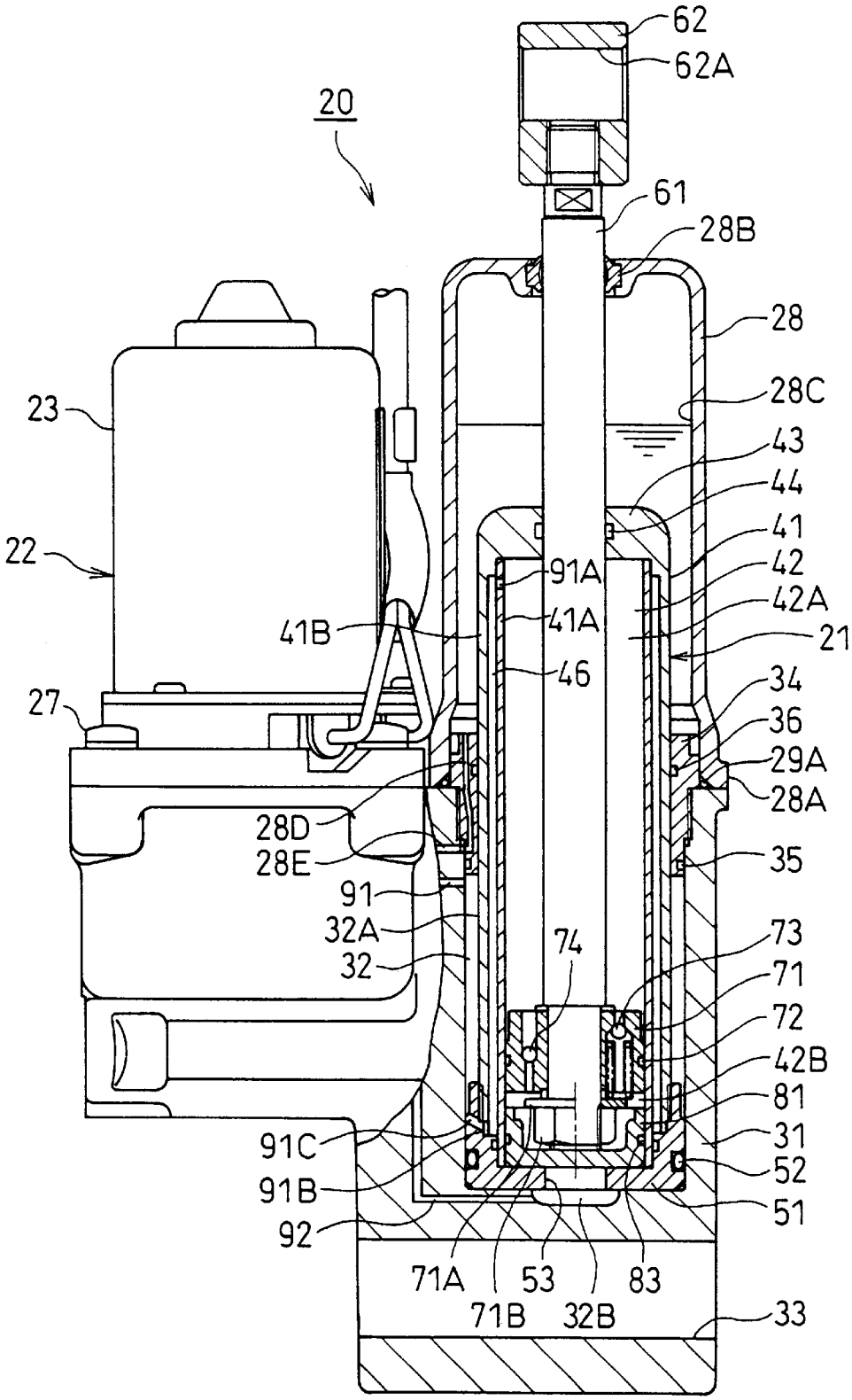
FIG. 2 is a view illustrating a trim-tilt device.

As illustrated in FIGS. 1 and 2, the cylinder device 21 of the trim-tilt device 20 has a housing 31 that is used by being connected to the damp bracket 12, the housing 31 having a large-diameter trim chamber 32 formed therein. It is to be noted that the housing 31 is casted-molded using, for example, an aluminum alloy, and is equipped with a mounting-pin insertion hold 33 for mounting the housing onto the damp bracket 12.

Also, the cylinder device 21 has a cylinder 41 which when the trimup/down operation in the trim region is performed becomes telescopically inserted into a trim chamber 32 from a cylinder guide 34 provided in an open end of the housing 31, the cylinder 41 having a small-diameter tilt chamber 42 formed therein. The cylinder guide 34 is screwed to an opening end of the housing 31 and is provided with a seal member 35 such as an O-ring or the like which closely contacts with the trim chamber 32 and a seal member 36 such as an O-ring or the like which slides on an outer surface of the cylinder 41.

Also, the cylinder device 21 has a large-diameter trim piston 51 screwed and fixed to an end portion of the cylinder 41 that is situated in the trim chamber 32 of the housing 31. The trim piston 51 is equipped with a seal member 52 such as an O-ring which slides on an inner surface of the trim chamber 32 and partitions the trim chamber 32 into a first trim chamber 32A on a cylinder 41 accommodation side and a second trim chamber 32B on an anti cylinder 41 accommodation side.

Also, the cylinder device 21 has a piston rod 61 that is provided by being connected to the swivel bracket 14. The piston rod 61 is inserted into the tilt chamber 42 for a rod guide portion 43 that is provided in an open end of the cylinder 41 as to be expanded and contracted when the tilt-up/down operation in the tilt region is performed. The rod guide portion 43 is equipped with a seal member 44 such as an O-ring which is in sliding contact with an outer surface of the piston rod 61. The piston rod 61 is equipped with a mounting-pin insertion hole 62A for mounting the cylinder device 21 onto the swivel bracket 14 to an mounting joint 62.

Also, the cylinder device 21 has a small-diameter tilt piston 71 that is fixed to an end portion of the piston rod 61 situated within the tilt chamber 42 of the cylinder 41 by a nut 71B through a washer 71A. The tilt piston 71 is equipped with an seal member 72 such as an O-ring which is in sliding contact with the inner surface of the cylinder 41, and partitions the tilt chamber 42 into a first tilt chamber 42A on a piston-rod 61 accommodation side and a second tilt chamber 42B on an anti piston-rod 61 accommodation side.

The tilt piston 71 has an expansion side buffer valve 73 and a check valve 74. The expansion side buffer valve 73 is opened by a set pressure for the purpose of guarding a hydraulic circuit when an impact is received in the expansion direction at cylinder device 21, as for example, when an obstacle such as a floating log or the like collides with the propulsion unit 15, and transfers the hydraulic fluid of the first tilt chamber 42A to a side of a free piston 81 as later described situated within the second tilt chamber 42B, thereby enabling the expansion of the piston rod 61. At this time, the free piston 81 remains at its own position and only the tilt piston 71 alone works. The check valve 74 is opened when after the valve described opening of the expansion side buffer valve 73 the tilt piston 71 of the piston rod 61 tends to return by the weight of the propulsion unit 15 to the original position to thereby return the hydraulic fluid between the tilt piston 71 and the free piston 81 to the first tilt chamber 42A Also, the cylinder device 21 has the free piston 81 which is usually set to the position of its contact with the tilt piston 71 within the second tiltchambers 42B and 42C of the cylinder 41. The free piston 81 is equipped with a seal member 83 such as an O-ring which contacts the inner periphery of the cylinder 41.

Figure 6:
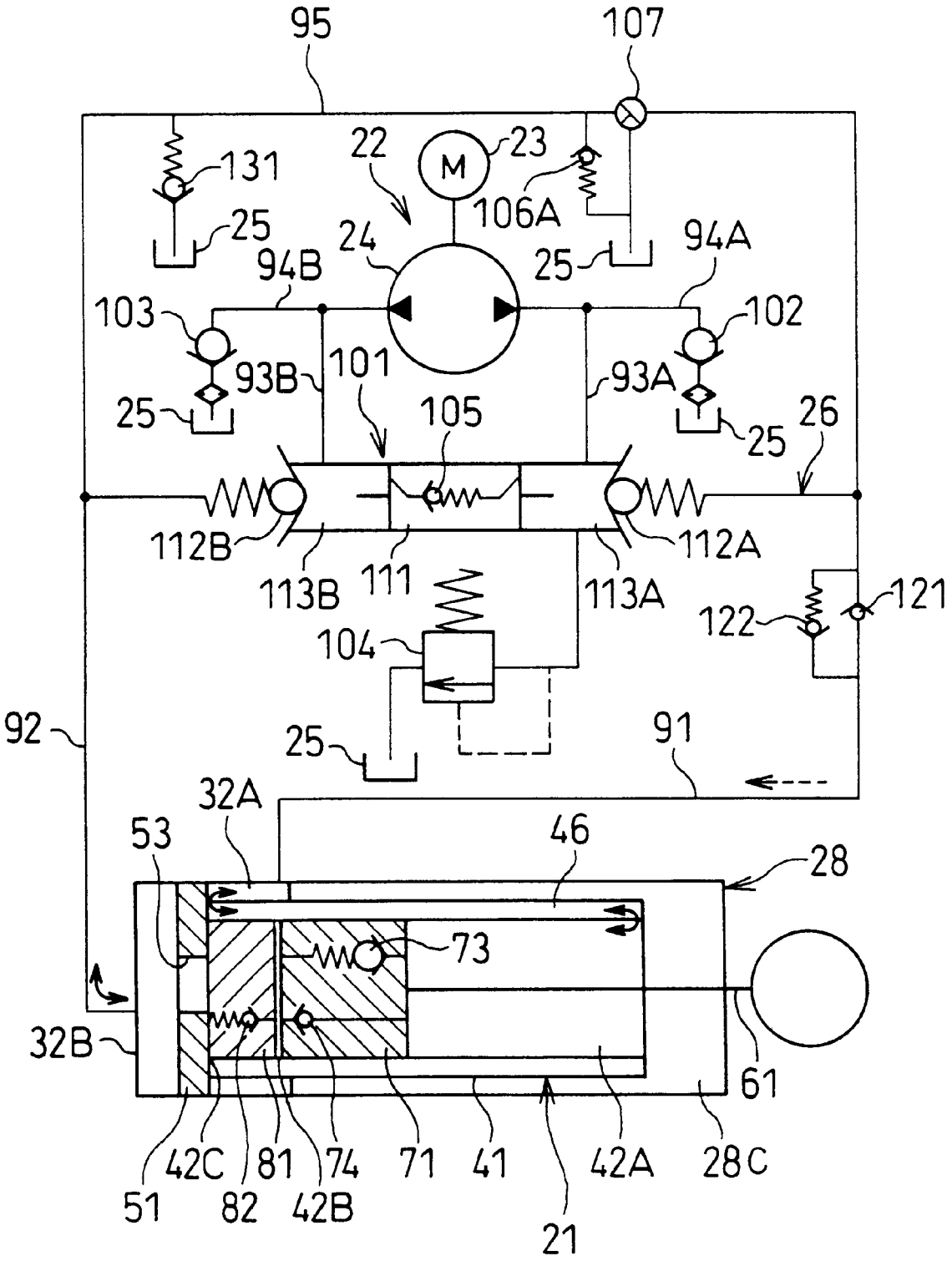
FIG. 6 is a view illustrating a hydraulic circuit of a trim-tile device.

Additionally, the free piston 81 has a reset one-way valve 82 (shown in FIG. 6, not shown in FIG. 2). When the marine propulsion unit 10 in a forward motion collides with an obstacle, when the brake is applied to the marine propulsion unit 10 in a forward motion, or when the external force in the expansion direction of the cylinder device 21 is applied for some reason upon start-up of the operation, the reset one-way valve 82 is opened so that it is reset to the former position, in which the tilt piston 71 and the free piston 81 contact each other. Further, when a buffer valve at the expansion side 73 is opened to extend the piston rod 61, a hydraulic fluid which is transferred from the first tilt chamber 42A to the second tilt chamber 42B is inserted between the tilt piston 71 and the free piston 81. Here, the free piston 81 is at the lowest position and the free piston 81 moves forward while compressing the piston rod 61 by the pump action, the reset one-way valve 82 is opened so that it is reset to the former position, in which the tilt piston 71 and the free piston 81 contact each other.

In the cylinder device 21, the cylinder 41 may be formed of iron material by forging, and on outer pipe 41B and the above-mentioned rod guide portion 43 may be integrally formed by forging, so that the number of assembling steps is reduced and a high strength is achieved. An inner pipe 41A is sandwiched between a recessed portion provided at an inner end face of the rod guide portion 43 and a recessed portion provided at an inner end face of the above-mentioned trim piston 51 screwed to the outer pipe 41B, so that the cylinder 41 is structured as a tilt cylinder assembly. As a result of this, the cylinder 41 has a doubled-pipe structure comprising the inner pipe 41A and the outer pipe 41B, where a gap between the inner pipe 41A and the outer pipe 41B, is used as a communication passage 46 for communicating the first trim chamber 32A and the first tilt chamber 42A with each other. The first trim chamber 32A is connected directly to a first flow passage 91 formed in the housing 31 while on the other hand the first tilt chamber 42A is connected to the first flow passage 91 through a passage 91A formed in the inner pipe 41A of the cylinder 41, a passage 91B formed in the outer pipe 41B of the cylinder 41, a passage 91C formed in the trim piston 51, and the first trim chamber 32A As a result of this, the first trim chamber 32A and the first tilt chamber 42A are connected, (a) through the first flow passage 91, with the supply side of the hydraulic fluid supply/discharge device 22 during the contraction stroke of each of the trim and tilt operations and, (b) through the first flow passage 91, with the discharge side of the hydraulic fluid supply/discharge device 22 during the expansion stroke of each thereof.

In the cylinder device 21, the trim piston 51 has a through-hole like communication passage 53 for connecting together second trim chamber 32B and the second tilt chamber 42C. The second trim chamber 32B is connected directly to a second flow passage 92 formed in the housing 31 and the second tilt chamber 42C is connected to the second flow passage 92 through the free piston 81 and the communication passage 53 of the trim piston 51 and the second trim chamber 32B. As a result of this the second trim chamber 32B and the second tilt chamber 42C are communicated (a) for the second flow passage 92, with the supply side of the hydraulic supply/discharge device 22 during the expansion stroke of each of the trim and tilt operations and (b) through he second flow passage 92 with the discharge side of the hydraulic fluid supply/discharge device 22 during the contraction stroke of each thereof.

(Hydraulic Fluid Supply/Discharge Device 22)

The hydraulic fluid supply/discharge device 22 comprises a reversible motor 23, a reversible gear pump 24, a tank 25, and a switching-valve equipped flow passage 26, by which the hydraulic fluid can be supplied and discharged, through the first flow passage 91 and the second flow passage 92, between the hydraulic fluid supply/discharge device 22 and the first trim chamber 32A, second trim chamber 32B, first tilt chamber 42A and a second tilt chamber 42C of cylinder device 21.

Figure 5:
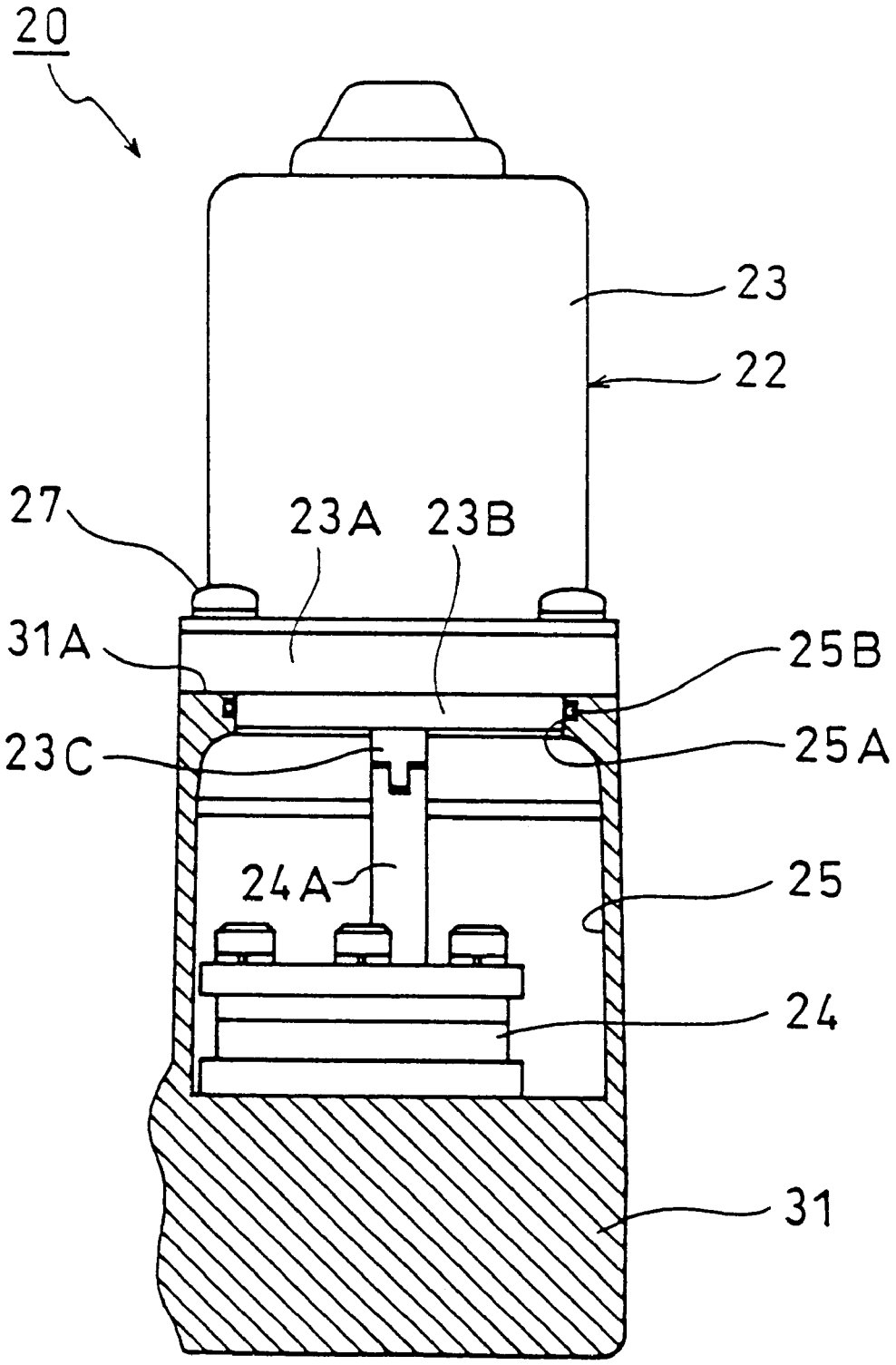
FIG. 5 is a view illustrating a state where a hydraulic fluid supply/discharge device is assembled into a housing of a cylinder device.

At this time, as illustrated in FIG. 5, the hydraulic fluid supply/discharge device 22 is arranged with a mounting base 23A for mounting a motor 23 installed on a motor installation surface 31A formed in the housing 31 of the cylinder device 21. The mounting base 23A is fixed thereto by bolts 27, whereby the motor 23 is laterally juxtaposed with the cylinder 41 of the cylinder device 21.

The hydraulic fluid supply/discharge device 22 has a void space portion that forms a side of the trim chamber 32 in the housing 31 of the cylinder device 21 in such a way as to surround the same and uses this void space portion as the tank 25 in which the hydraulic fluid is stored. As opening 25A is formed in the portion within the tank 25 of the housing 31 which corresponds to a lower portion of the motor 23, whereby a fitting portion 23B that connects to the mounting base 23A of the motor 23 is fluid-tightly fitted into the opening 25A through a seal member 25B such as an O-ring. Under the motor 23 within the tank formed in the housing 31, the pump 24 is fixedly disposed in a state of essentially constant immersion in the fluid, whereby an output shaft 23C protruding from the fitting portion 23B of the motor 23 is connected to a driven shaft 24A of the pump 24.

Figure 3:
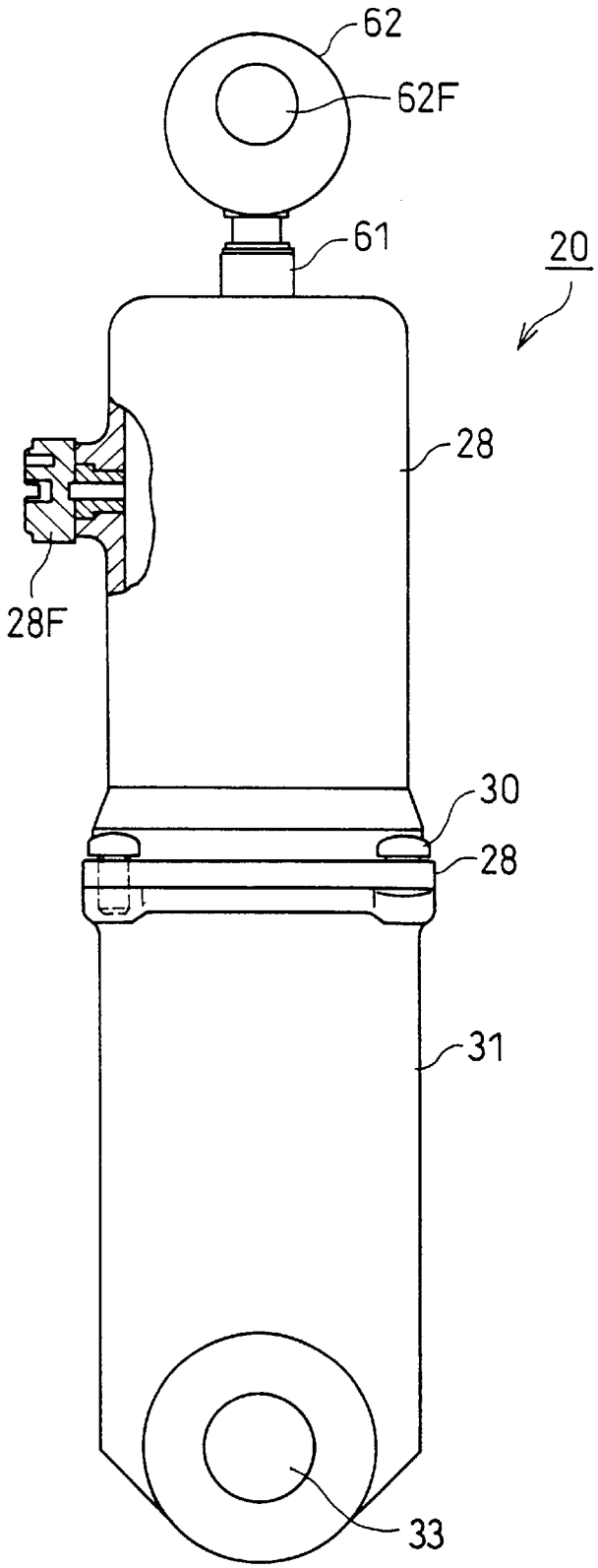
FIG. 3 is a side view of FIG. 2.
Figure 4:
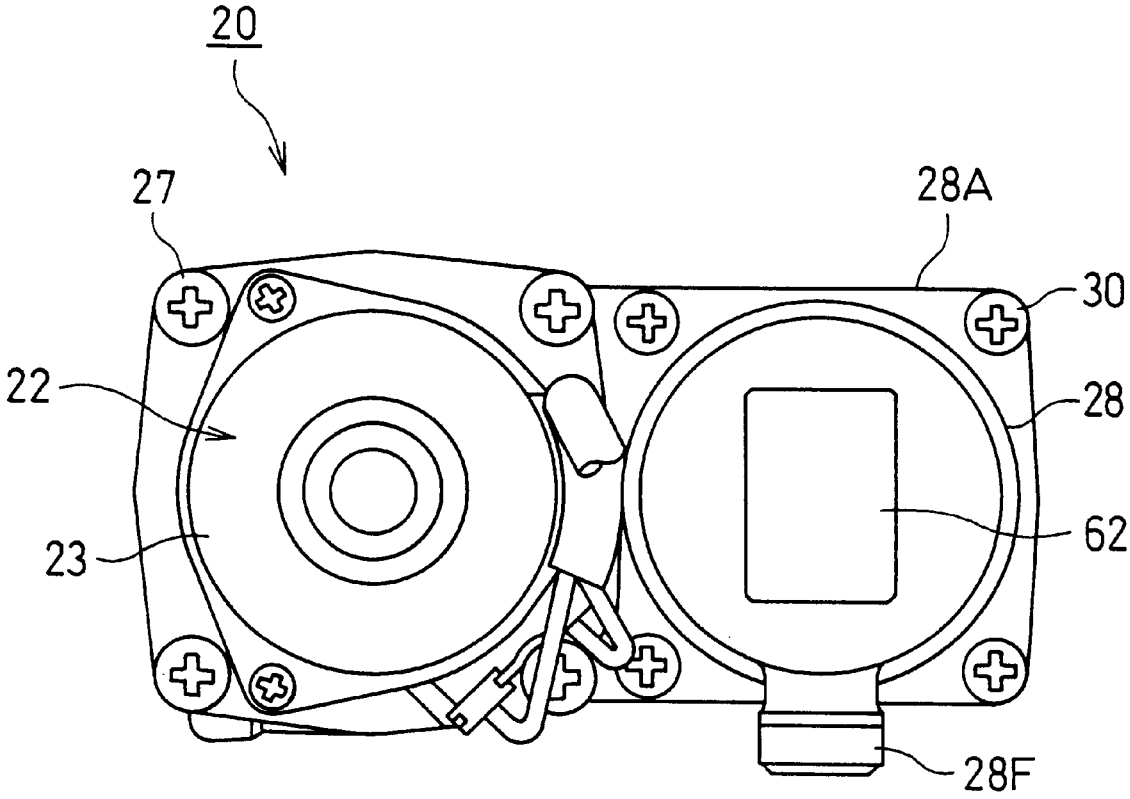
FIG. 4 is a plan view of FIG. 2.

Additionally, in the embodiment of the present invention, a portion of the cylinder 41 of the cylinder device 21 which projects outward from the cylinder guide 34 of the housing 31 in the trim operation area is covered with a sub-tank housing 28 constituting the hydraulic fluid supply/discharge device 22. The sub-tank housing 28 is made of, for example, resin, a lower end opening portion of the sub-tank housing 28 is fitted on the cylinder guide 34, and a lower end flange portion 28A of the sub-tank housing 28 is fluid-tightly fastened to an opening end face of the housing 31 through an O-ring 29A by bolts 30. An upper end opening portion of the sub-tank housing 28 is provided with a seal member 28B such as an oil seal or the like which allows sliding of the piston rod 61 fluid-tightly. As a result of this, the sub-tank housing 28 is provided in a standing manner along the longitudinal directions of the cylinder 41 and the piston rod 61 with a constant clearance about the cylinder 41 and the piston rod 61, thereby forming a sub-tank 28C. The sub-tank 28C communicates with the above-mentioned tank 25 of the housing 31 through a passage 28D formed in the cylinder guide 34 and a passage 28E formed in the housing 31. In FIGS. 3 and 4, reference numeral 28F denotes an oil syringe plug.

The switching-valve equipped flow passage 26 of the hydraulic fluid supply/discharge device 22 which connects the pump 24 to the first flow passage 91 and second flow passage 92 is built in the housing 31, the switching valve equipped flow passage 26 being provided with a shuttle type switching valve 101, check valves 102 and 103, contraction side relief valve 104, expansion side relief valve 105, contraction side buffer valve 106A and manual switching valve 107.

The shuttle type switching valve 101 has a shuttle piston 111 and a first check valve 112A and second check valve 112B that are located on both sides of the shuttle piston 111, and defines a first shuttle chamber 113A on the first check valve 112A side of the shuttle piston 111 and defines a second shuttle chamber 113B on the second check valve 112B side of the shuttle piston 111. The first check valve 112A is opened by the pressure of the transmission fluid applied to the first shuttle chamber 113A through a pipe passage 93A by the pump 24 rotating in the forward direction. The second check valve 112B can be opened by the pressure of the transmission fluid applied to the second shuttle chamber 113B through a pipe passage 93B by the pump 24 rotating in the reverse direction. Also, the shuttle piston 111 opens the second check valve 112B by the pressure of the transmission fluid resulting from the forward rotation of the pump 24 and can open the first check valve 112A by the pressure of the transmission fluid resulting from the reverse rotation of the pump 24.

The first check valve 112A of the shuttle type switching valve 101 is connected to the first flow passage 91 and the second check valve 112B is connected to the second flow passage 92.

A check-valve 102 is mounted on a connection pipe passage 94A between the pump 24 and the tank 25. In the tilt-up stage of the marine propulsion unit 10, the internal volume of the cylinder 41 is insufficient in volume and the piston rod 61 is retracted, with the result that the circulating amount of the hydraulic fluid becomes deficient by that extent. Therefore, the check valve 102 is opened to thereby supplement from the pump 25 to the pump 24 the portion which corresponds to the deficiency of the circulating amount of fluid.

A check valve 103 is mounted on a connection pipe passage 94B between the pump 24 and the tank 25. The pump 24 is still in an operative stage at the point in time when, at the trim-down stage of the marine propulsion unit 10, the trim piston 51 reaches its position of maximum contraction at which the trim-down stage is completed. As a result the return fluid from the second trim chamber 32B to the pump 24 stops, and the check valve 103 is opened whereby the hydraulic fluid can be supplied from the tank to the pump 24.

The contraction side relief valve 104 is connected to the first shuttle chamber 113A. The contraction side relief valve 104is intended to permit the hydraulic circuit pressure to be relieved into the tank 25 under a set pressure in order to return to the tank 25 the amount of fluid corresponding to the volume of the rod, which is to remain at the time of the tilt-down and trimdown operations, and in order to guard the hydraulic circuit while continuing to operate the pump 24 even after the trim-down operation has been completed.

The expansion side relief valve 105 is built into the shuttle piston 111. The valve 105 is intended to permit the hydraulic circuit pressure to be relieved into the tank 25 under a set pressure in order to guard the hydraulic circuit while continuing to operate the pump 24 even after the tilt-up operation time is completed, and the piston rod 61 has reached its position of maximum expansion.

The contraction side buffer valve 106A is intended to relieve the hydraulic circuit pressure under a set pressure into the tank 25 when an impact has been applied to the propulsion unit 15 in the contraction direction of the piston rod 61, for example, when an obstacle has bumped against the propulsion unit 15 from behind, with the tilt piston 71 and free piston 81 of the cylinder device 21 being located at an intermediate position of the tilt chamber 42.

The manual switching valve 107 is interposed on a connecting passage 95 between the first flow passage 91 and the second flow passage 92, and by connecting the first flow passage 91 and the second flow passage 92 and the tank 25 with each other. This permits manual expansion and contraction of the cylinder device 21 to thereby make the propulsion unit 15 tiltable in each of the trim and tilt regions.

Further, in order to avoid that a tilt-up operation is carried out faster than a trim-up operation when the cylinder device 21 expands (up), even when an external force, such as a backward driving force during backward sailing or an uplifting force of a wave tending to raise the marine propulsion unit 15, acts in the direction for expanding the cylinder device 21, the marine propulsion unit 10 has a check valve 121 and a relief valve 122 in the hydraulic fluid supply/discharge device 22. In the hydraulic fluid supply/discharge device 22 the check valve 121 allows the hydraulic fluid to flow from the pump 24 to the first trim chamber 32A and the first tilt chamber 42A and the relief valve 122 which is opened if the hydraulic pressure of the first trim chamber 32A and the hydraulic pressure of the first tilt chamber 42A become higher than a fixed value are connect in parallel to the first flow passage 91 connecting the first trim chamber 32A and the first tilt chamber 42A to the pump 24. Therefore, even when an external force, such as a backward driving force during backward sailing or an uplifting force of a wave to raise a marine propulsion unit 15, acts in the direction for expanding the cylinder device 21, the cylinder device 21 is provided so as to operate telescopically so that it can start a tilt-up movement of the tilt piston 71 after the cylinder device 21 finishes the trip-up movement of the trim piston 51.

Figure 7:
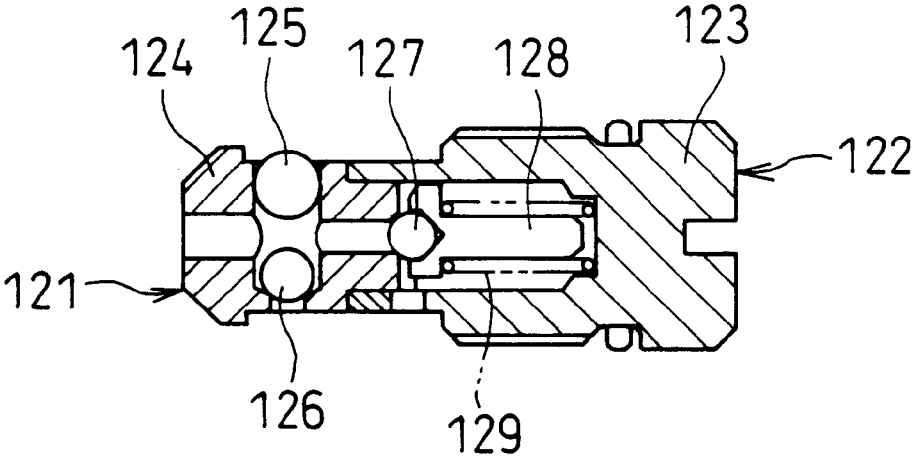
FIG. 7 is a cross sectional view illustrating a relief valve with a check valve.

Additionally, FIG. 7 illustrates a relief valve 122 comprising a check valve 121, a valve body 123, a valve sheet 124 which is pressed into the valve body 123, a blind plug 125, a ball 126 of the check valve 121, a ball 127 of the relief valve 122, a spring sheet 128 and a relief spring 129.

The marine propulsion unit 10 has a relief valve 131 in the hydraulic fluid supply/discharge device 22, to avoid an abnormal application of pressure of the tanks 25 and 28C caused during forward sailing, where the operation of the pump 24 of the trim-tilt device 20 stops in a trim operable region, the state in which the cylinder device 21 does not finish the trim up and an obstacle in the water such as a floating log etc., collides with the propulsion unit 15. When the hydraulic fluid supply/discharge flow passages 91 and 92, from the hydraulic fluid supply/discharge device 22 to the cylinder device 21, are locked, a piston rod 61 and the cylinder 41 carry out a trim-stroke in a body to the housing 31, the tank housing 28 and the tanks 25 and 28C. The relief valve 131 is provided on a bottom in which a pump 24 is fixed on a lower part of a motor 23 of the tanks 25. The relief valve 131 is connected to a flow passage 95 (92) communicating with the second trim chamber 32B. The relief valve 131 is opened due to the boosting of the hydraulic pressure in the tanks 25 and 28C beyond a fixed value so that it can transfer the hydraulic fluid of the tanks 25 and 28 into the second trim chamber 32B. Thus, an abnormal application of hydraulic pressure of the tanks 25 and 28C by transfer of the cylinder 41 (trim-stroke) can be avoided when the obstacle in the water collides with the propulsion unit 15 and the impact is added in the expansion direction of the cylinder 21.

Figure 8:
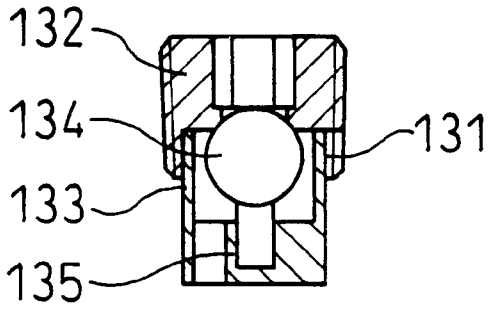
FIG. 8 is a cross sectional view illustrating a relief valve.

FIG. 8 illustrates the relief valve 131, a valve body 132, a valve collar 133 which is pressed into the valve body 132, a ball 134 and a relief spring 135.

The operation of the trim-tile device 20 will hereafter be explained.

(1) Trim-Up

When the motor 23 and pump 24 are rotated in reverse, the hydraulic fluid discharged from the pump 24 flows from the pipe passage 93B to the second shuffle chamber 113B of the shuffle type switching valve 101, whereby the shuffle piston 111 moves to the right side in FIG. 6 to thereby forcibly open the first check valve 112A. Also, the hydraulic fluid that has flown into the second shuttle chamber 113B of the switching valve 101 forcibly opens the second check valve 112B by its own pressure and is thereby sent to the second trim chamber 32B through the pipe passage 92 as indicated by a solid-line arrow. The hydraulic fluid that has flowed into the second trim chamber 32B in this way tends to push up the trim piston 51. It is to be noted that the hydraulic fluid of the second trim chamber 32B not only acts on the trim piston 51 but also acts on the tilt piston 71 in close contact with the trim piston 51 through the through-hole connecting passage 53 of the trim piston 51. Since the pressure receiving area of the connecting passage 53 is set so that the pressure receiving area of the trim piston 51 may be larger than that of the tilt piston 71, the trim piston 51 pushes up and moves the tilt piston 71. At this time, the hydraulic fluid of the first trim chamber 32A flows out into the first flow passage 91 and further returns to the pump 24, and therefore the trim piston 51 is moved. Simultaneously, the cylinder 41 and piston rod 61 are caused to protrude outwardly from the housing 31, whereby trim-up occurs.

When the trim piston 51 has collided with the stroke end in the trim-up direction within the first trim chamber 32A, the trim-up is maximized.

(2) Tilt-Up

After under the above item (1) the trim piston 51 has been moved up to a level corresponding to the maximum trim-up the hydraulic fluid within the second trim chamber 32B. The hydraulic fluid is further supplied to the second trim chamber 32B extends from the through-hole like connecting passage 53 formed in the trim piston 51 to an anti-piston rod 61 side of a tilt piston 71 end surface through the free piston 81. As a result of this, the hydraulic fluid supplied to the second trim chamber 32B is filled in to the second tilt chamber 42C formed while being gradually expanded between the trim piston 51 within the cylinder 41 and the free piston 81, and the tilt piston 71. The hydraulic fluid within the first tilt chamber 42A flow out into the first flow passage 91 through the passage 9 1A formed in the rod guide portion 43 of the cylinder 41, connecting passage 46 of the cylinder 41, passage 91B formed in the outer cylinder 41B of the cylinder 41, passage 91C formed in the trim piston 51 and first trim chamber 32A Therefore, the tilt piston 71 and the free piston 81 are moved together. As a result of this, the piston rod 61 protrudes outwardly from the cylinder 41, whereby tilt-up occurs. When the tilt piston 71 collides with the stroke end in the tilt-up direction within the first tilt chamber 42A, the tilt-up reaches it's maximum.

(3) Tilt-Down

When the motor 23 and pump 24 are rotated in a forward direction, the hydraulic fluid discharged from the pump 24 flows from the pipe passage 93A into the first shuttle chamber 113A of the switching valve 101, whereby the shuttle piston 111 is moved to the left side in FIG. 6 to thereby forcibly open the second check valve 112B. The hydraulic fluid that has flown into the first shuttle chamber 113A of the switching valve 101 forcibly opens the first check valve 112A by its own pressure and, as indicated by a broken-line arrow, is sent from the first flow passage 91 to the first tilt chamber 42A through the first trim chamber 32A, passage 91C, passage 91B, communication passage 46 of the cylinder 41 and passage 91A When hydraulic fluid flows into the first tilt chamber 42A in this way, the hydraulic fluid pushes down the tilt piston 71, and the free piston 81. At this time, the hydraulic fluid of the first trim chamber 32A acts on the trim piston 51. However, the pressure-receiving area of the tilt piston 71 facing the first tilt chamber 42A is so set as to become larger than that of the trim piston 51 facing the first trim chamber 32A and therefore only the tilt piston 71 alone is depressed until the tilt piston 71 collides with the trim piston 51. As a result of this, the piston rod 61 is retracted into the cylinder 41 and is tilted down. At this time, the hydraulic fluid of the second tilt chamber 42C flows out from the through-hole connecting passage 53 of the trim piston 51 into the second flow passage 92 through the second trim chamber 32B and further into the pump 24. When the tilt piston 71 collides with the trim piston 51 that is kept at the stroke end on the trim-up direction of the trim chamber 32, the tilt-down is completed.

(4) Trim-Down

When after the tilt-down described above (3) terminates, the hydraulic fluid is supplied to the first trim chamber 32A and first tilt chamber 42A, the tilt piston 71 and the free piston 81 is depressed down to the second trim chamber 32B side integrally with the trim piston 51. The hydraulic fluid within the second trim chamber 32B flows out into the second passage 92, with the result that the cylinder 41 and the piston 61 are retracted further into the housing 31 for trim-down operation. And when the trim piston 51 collides with the stroke end in the trim-down direction within the second trim chamber 32B, the trim-down is completed.

Here, in the trim-tilt device 22, during a transition process from the trim-up to the tilt-up operation under the above items (1) and (2) and during a transition process from the tilt-down to the tri-down operation under the above items (3) and (4), the effective area of each of the pistons 51 and 71 varies between the large-diameter trim piston 51 and the small-diameter tilt piston 71. For this reason, the transfer speed of the piston rod 61 is such that transition speed in the trim region is less than that in the tilt region while, on the other hand the force that acts on the piston rod 61 is such that this force in the trim region is greater than in the tilt region. In the above-described embodiment, it is possible, (a) in the trim region, to finely adjust the trim angle while resisting the trust force of the propeller and also to sail in a shallow water area, and (b) in the tilt region, it is possible to quickly perform tilt up/down operations with a relatively small magnitude of force that is necessary for supporting the weight of the propulsion unit itself.

Therefore, the present embodiment has the following effects.

(A) Securing a trim-up operation when an external force for expanding the cylinder device 21 acts during backward sailing or the like (1) The check valve 121 and the relief valve 122 are connect in parallel to the hydraulic fluid flow passage 91 in which the first trim chamber 32A and the first tilt chamber 42A are connected to the pump 24. The check valve 121 introduces the discharging fluid of the pump 24 into the first trim chamber 32A and the first tilt chamber 42A (an upper chamber) upon a down operation of the cylinder device 21. The relief valve 122 can carry out an up operation only when the hydraulic pressure of the first trim chamber 32A and the first tilt chamber 42A increases upon an up operation to push open the relief valve 122. Accordingly, if the discharging hydraulic fluid of the pump 24 is supplied to the second trim chamber 32B (a lower chamber) in order to carry out an up operation of the cylinder device 21 when an external force, such as a backward driving force during backward sailing or an uplifting force of a wave to raise a marine propulsion unit 15, acting in the direction for expanding the cylinder device 21, the hydraulic pressure of the second trim chamber 32B increases the hydraulic pressure of the first trim chamber 32A and the first tilt chamber 42A (an upper chamber) through the trim piston 51 and the tilt piston 71. At this time, the relief valve 122 is dosed until the increased hydraulic pressure is increased to reach the relief pressure so that the hydraulic pressure flow passage from the first tilt chamber 42A to the pump 24 absorption side is kept unlocked. When the hydraulic pressure of the first trim chamber 32A and the first tilt chamber 42A increases to reach the relief pressure, the relief valve 122 is opened and the trim piston 51, which has a larger pressure-receiving area at the lower chamber side than that of the tilt piston 71, carries out an up operation ahead of the tilt piston 71.

(2) The set pressure P of the relief valve 122 describe above in (1) is desirably larger that the external force Fa such as a backward driving force acting on the pressure receiving area S of the tilt piston 71. The set pressure P satisfies $P<Fa/S$. For example, it is assumed that P is 30 $kgf/cm^2$. In this case, when the relief pressure P is excessively high, the efficiency of the pump 24 is decreased and it suffers from a heavy load. Therefore, for example, it is determined that $P=30\pm10$ $kgf/cm^2$. However, because of the influence by the lost pressure in a pipe passage or the friction or the like, the relief pressure P may be smaller that the valve in $P>Fa/S$.

(B) Avoidance of an abnormal application of pressure of the tank 25 by transfer of the cylinder 41 (a trim-stroke) according to the collision with an obstacle in the water, (1) The relief valve 131, that is opened due to the increase of the inner pressure of the tanks 25 and 28C greater than a fixed value and transfers the hydraulic fluid of the tanks 25 and 28C to the second trim chamber 32B, is provided. Accordingly, when the marine propulsion unit 15 collides with an obstacle in the water, the piston rod 61 and the cylinder 41 carry out in a body a trim-stoke in the tank housing 28. Therefore, even when the internal pressure in the tanks 25 and 28C suddenly increases, it is possible to let out the inner pressure immediately to the second trim chamber 32B side by the above-mentioned relief valve 131. Thus, it becomes possible that an abnormal application of pressure of the tanks 25 and 28C is avoided, the housing 28 made of resin is prevented from being destroyed, or an end plate which is made of resin of the pump motor 23, covering the pump chamber which is provided in communicating with this tank 28C is prevented from being destroyed.

(2) In order to absorb an abnormal application of pressure of the tanks 25 and 28C, it is not necessary to increase the air capacity of the tanks 25 and 28C, so that the tanks 25 and 28C are prevented from increasing in size.

(3) The value of the set pressure of the relief valve 131 described above may be small if the relief valve 131 is not opened by a small negative pressure of the tanks 25 and 28C, namely, it may be small enough to get the stability of an opening valve operation of the relief valve 131. For example, the value of the set pressure of the relief valve 131 may be between 1–3 kgf/cm$^2$.

The present embodiment has the following effect.

(1) Since the cylinder 41 if the cylinder device 21 is covered with the tank 28C, it is prevented from contacting with outer water and it is easily and reliably made rustproof by hydraulic fluid in the tank housing 28. As a result of this, even when the cylinder 41 serving as a member for transmitting a propulsion force (axial compressing force) between the hull 11 and the marine propulsion unit 15 is made of metal material such as iron, such that a predetermined strength for accommodating forces can be secured at a small area, it is unnecessary to structure the cylinder 41 with a high grade rustproof material or to perform a rustproof treatment such as coating, so that the number of machining steps for rustproof treatment can be reduced and cost can be decreased.

(2) Since the outer surface of the cylinder 41 is made rustproof according to the above (1), rust does not occur thereon. Therefore, even when the cylinder 41 repeatedly slides on the seal member 35 of the cylinder guide 34 provided on the housing 31 in the trim operation area, the outer surface of the cylinder 41 does not scratch the seal member 35.

(3) The tank housing 28 of the hydraulic fluid supply/discharge device 22 covers the entire of the cylinder 41 projecting outward from the housing 31 along the longitudinal direction of the cylinder 41. As a result of this, the tank housing 28 extends along the longitudinal direction of the cylinder 41 and it does not budge laterally about a proximal portion of the cylinder 41 so that the trim-tilt device 20 can be made compact.

Here, the housing 31 of the cylinder device 21 is formed of, for example, aluminum alloy by forging integrally with the tank 25 of the hydraulic fluid supply/discharge device 22, and it is not prevented from rusting. Also, the sub-tank housing 28 is made of, for example, resin to be rustproof.

Incidentally, such a treatment as plating can be performed on the outer peripheral surface of the cylinder 41, thereby improving sliding performance of the housing 31 with respect to the cylinder guide 34.

(4) Since the first trim chamber 32A and the first tilt chamber 42A have been interconnected with each other by the passage 46 provided in the wall of the cylinder 41, the exposure to the outside of the pipes of hydraulic fluid supplied and discharged from the supply/discharge device 22 to cylinder device 21 can be suppressed. As a result of this, the outer appearance of the cylinder device 21 is compact and there is no likelihood that exposed piping will be damaged and that hydraulic fluid will leak from the connection. At this time, since the connecting passage 46 between the first trim chamber 32A and the first tilt chamber 42A is provided within the wall of the cylinder 41, the cylinder device 21 is simple in construction.

(5) The portions where the cylinder device 21 should be fluid-tightly sealed are only four in number and those include a portion (seal member 35) where the cylinder 41 slides on the cylinder guide 34 provided in the housing 31, a portion (seal member 52) where the trim piston 51 slides on the inner surface of the trim chamber 32 of the housing 31, a portion (seal member 44) where the piston rod 61 slides with respect to the rod guide portion 43 provided in the cylinder 41 and a piston seal member 72 where the tilt piston 71 slide on the inner surface of the tilt chamber 42 of the cylinder 41. Therefore, the sealability of the cylinder device 21 is greatly improved (6) The tilt piston 71 is moved up and down merely by sliding contact of its outer peripheral portion with the inner surface of the tilt chamber 42 of the cylinder 41 which is made during tilt operation. Therefore, the assembling efficiency and slideability thereof are high and so the tilt-operating efficiency is improved.

(7) By making the cylinder 41 of the cylinder device 21 into a double cylinder structure, the double cylinder structure is made up through the connection of the inner pipe 41A and the outer pipe 41B and the gap between both pipes 41A and 41B can be used as the connecting passage 46 between the first trim chamber 32A and the first tilt chamber 42A As a result of this, construction of the cylinder device 21 is greatly simplified.

(8) By building the pump 24, the tank 25 and the switching valve equipped flow passage 26 of the hydraulic fluid supply/discharge device 22 into the housing 31 of the cylinder device 21, the connecting flow passages between the hydraulic fluid supply/discharge device 22 and the cylinder device 21 are not outwardly exposed, and it is possible to eliminate all use of exposed piping over the entire trim-tilt device 20 with (4).

(9) The hydraulic fluid supply/discharge device 22 is integrally assembled to the cylinder device 21. By respectively connecting the housing 31 and the piston rod 61 of the cylinder device 21 to the hull 11 and marine propulsion unit 10, the mounting of the hydraulic fluid supply/discharge device 22 also is simultaneously completed.

However, in the present invention, the connecting passage that is built into the wall of the cylinder and that connects the first trim chamber and the first tilt chamber with each other may be constructed of a hole-like passage formed in the wall of the cylinder. At this time the cylinder may be formed by using a casting and the hole-like passage may be formed by casting. Or, the cylinder may be formed using a pipe and the hole-like passage may be formed in the wall of the pipe.

As heretofore explained, embodiments of the present invention have been described in detail with reference to the drawings. However, the specific configurations of the present invention are not limited to the embodiments but those having a modification of the design within the range of the present invention are also included in the present invention.

As mentioned above, according to the present invention, it is an object to avoid an abnormal application of pressure of the pump by movement of a cylinder according to the collision of an obstacle in the water or the like in the case that a cylinder of a cylinder device is covered with a tank housing of hydraulic fluid supply/discharge device in a trim-tilt device for a marine propulsion unit.

Although the invention has been illustrated and described with respect to several exemplary embodiments thereof, it should be understood by those skilled in the art that the foregoing and various other changes, omissions and additions may be made to the present invention without departing from the spit and scope thereof Therefore the present invention should not be understood as limited to the specific embodiment set out above, but should be understood to include all possible embodiments which can be embodied within a scope encompassed and equivalents thereof with respect to the features set out in the appended claims.

What is claimed is:

1. A trim-tilt device for a marine propulsion unit, wherein a cylinder device is mounted between a hull and the marine propulsion unit freely tiltably supported by the hull; and wherein hydraulic fluid is supplied from a hydraulic fluid supply/discharge device into the cylinder device and is discharged from the cylinder device into the hydraulic fluid supply/discharge device to thereby expand and contract the cylinder device and thereby trim and tilt the marine propulsion unit, the cylinder device comprising:

a housing adapted to be connected to one of the hull and marine propulsion unit to form a large-diameter trim chamber;

a cylinder telescopically inserted into the trim chamber and forming a small-diameter tilt chamber;

a large-diameter trim piston fixed to an end portion of the cylinder within the trim chamber of the housing and serving to partition the trim chamber into a first trim chamber of a cylinder accommodation side and a second trim chamber of an anti cylinder accommodation side;

a piston rod adapted to be connected to the other of the hull and the marine propulsion unit that is telescopically inserted into the tilt chamber of the cylinder; and wherein the cylinder device has a small-diameter tilt piston comprising a buffer valve fixed to an end of the piston rod within the tilt chamber of the cylinder, which partitions the tilt chamber into a first tilt chamber of a piston rod accommodation side and a second tilt chamber of an anti piston rod accommodation side and wherein said buffer valve is opened when hydraulic pressure of the first tilt chamber becomes higher than a fixed value, so that hydraulic fluid of the first tilt chamber can transfer to the second tilt chamber;

a portion of the cylinder of said cylinder device which projects outward from the housing in a trim operable region being -covered with a tank housing constituting the hydraulic fluid supply/discharge device; and comprising a relief valve which is opened when hydraulic pressure of the tank housing becomes higher than a second fixed value so that hydraulic fluid of the tank housing can be relieved into the second trim chamber to avoid an abnormal application of pressure of a pump by movement of the cylinder due to addition of the import on the direction that expands the cylinder device to the marine propulsion unit.

2. The trim-tilt device for a marine propulsion unit according to claim 1, wherein a set pressure of said relief valve is defined between 1–3 kgf/cm$^2$.

3. The trim-tilt device for a marine propulsion unit according to claim 2, wherein said cylinder is repeatedly in sliding contact with a seal member of a cylinder guide provided in said housing in the trim operable region.

4. The trim-tilt device for a marine propulsion unit according to claim 1, wherein said tank housing constituting said hydraulic fluid supply/discharge device covers an entire body of said cylinder which projects outward from the housing in the trim operable region across the longitudinal direction of said cylinder.

5. The trim-tilt device for a marine propulsion unit according to claim 4, wherein said cylinder is repeatedly in sliding contact with a seal member of a cylinder guide provided in said housing in the trim operable region.

6. The trim-tilt device for a marine propulsion unit according to claim 1, wherein said cylinder is repeatedly in sliding contact with a seal member of a cylinder guide provided in said housing in the trim operable region.

* * * * *